US011644778B2

(12) United States Patent
Yabuki et al.

(10) Patent No.: US 11,644,778 B2
(45) Date of Patent: May 9, 2023

(54) IMAGE FORMING APPARATUS AND CONTROL METHOD THEREOF

(71) Applicant: BROTHER KOGYO KABUSHIKI KAISHA, Nagoya (JP)

(72) Inventors: Tomoyasu Yabuki, Nagoya (JP); Yoshifumi Kajikawa, Nagoya (JP); Takashi Suzuki, Nagoya (JP); Takashi Yasuda, Nagoya (JP); Takashi Shimizu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/752,961

(22) Filed: May 25, 2022

(65) Prior Publication Data

US 2022/0291616 A1 Sep. 15, 2022

Related U.S. Application Data

(63) Continuation of application No. 17/233,964, filed on Apr. 19, 2021, now Pat. No. 11,402,782, which is a (Continued)

(30) Foreign Application Priority Data

Jul. 7, 2017 (JP) ..... JP2017-133272

(51) Int. Cl.
*G03G 15/00* (2006.01)
*G03G 15/08* (2006.01)

(52) U.S. Cl.
CPC ..... *G03G 15/50* (2013.01); *G03G 15/0865* (2013.01); *G03G 15/0856* (2013.01); *G03G 15/553* (2013.01)

(58) Field of Classification Search
CPC .. G03G 15/0877; G03G 15/55; G03G 15/553; G03G 15/0865; G03G 15/0856;
(Continued)

(56) References Cited

U.S. PATENT DOCUMENTS 5,587,770 A 12/1996 Jo et al.
5,790,917 A 8/1998 Takura et al.
(Continued)

FOREIGN PATENT DOCUMENTS

AU 2008207628 A1 7/2009
AU 2014216008 A1 9/2014
(Continued)

OTHER PUBLICATIONS

Feb. 9, 2021—(JP) Notice of Reasons for Refusal—App 2017-133272, Eng Tran.
(Continued)

*Primary Examiner* — Jessica L Eley
(74) *Attorney, Agent, or Firm* — Merchant & Gould P.C.

(57) ABSTRACT

An image forming apparatus, including: a housing; a photoconductor; a developing unit configured to form a developer image on the photoconductor; a developer cartridge storing developer, the cartridge being removably mountable on the housing, a supplier configured to supply the developer from the developer cartridge to the developing unit; and a controller configured to execute a first printing process of forming a developer image by use of the developer supplied from the developer cartridge, when the developer cartridge is being mounted on the housing, and a second printing process of forming a developer image by use of the developer remaining in the developing unit, when a usage amount of the developing unit is not less than a predetermined value and the developer cartridge is not being mounted on the housing, wherein the controller does not execute the second
(Continued)

printing process when the usage amount is less than the predetermined value.

17 Claims, 6 Drawing Sheets

Related U.S. Application Data continuation of application No. 16/869,722, filed on May 8, 2020, now Pat. No. 11,009,821, which is a continuation of application No. 16/027,439, filed on Jul. 5, 2018, now Pat. No. 10,671,002.

(58) Field of Classification Search
CPC ..... G03G 2215/0177; G03G 15/50; G03G 15/0849; G03G 15/0862
See application file for complete search history.

(56) References Cited

U.S. PATENT DOCUMENTS

| | | | | |
|---|---|---|---|---|
| 6,512,896 | B2 | 1/2003 | Asanuma et al. | |
| 7,440,705 | B2 | 10/2008 | Hatakeyama | |
| 2001/0055493 | A1* | 12/2001 | Asanuma ..... | G03G 21/1878 399/25 |
| 2004/0081494 | A1 | 4/2004 | Bhatti et al. | |
| 2004/0146316 | A1 | 7/2004 | Yamada et al. | |
| 2005/0265738 | A1 | 12/2005 | Ogata | |
| 2006/0193646 | A1* | 8/2006 | Suzuki ..... | G03G 15/0855 399/12 |
| 2006/0216046 | A1 | 9/2006 | Hatakeyama | |
| 2007/0058993 | A1 | 3/2007 | Horinoe | |
| 2007/0058995 | A1 | 3/2007 | Onda et al. | |
| 2007/0122165 | A1 | 5/2007 | Igarashi et al. | |
| 2007/0253748 | A1 | 11/2007 | Matsumoto et al. | |
| 2008/0095554 | A1 | 4/2008 | Katogi et al. | |
| 2008/0273047 | A1 | 11/2008 | Kawarazuka et al. | |
| 2009/0110425 | A1 | 4/2009 | Uno et al. | |
| 2010/0003058 | A1 | 1/2010 | Hori et al. | |
| 2013/0028638 | A1 | 1/2013 | Tsuritani et al. | |
| 2013/0039667 | A1 | 2/2013 | Osawa et al. | |
| 2013/0272726 | A1 | 10/2013 | Sunahara | |
| 2014/0186058 | A1* | 7/2014 | Shimizu ..... | G03G 21/1839 399/119 |
| 2015/0037049 | A1 | 2/2015 | Shiraishi et al. | |
| 2016/0179048 | A1 | 6/2016 | Okada | |

FOREIGN PATENT DOCUMENTS

| | | | |
|---|---|---|---|
| AU | 2017201268 | A1 | 3/2017 |
| CN | 1828446 | A | 9/2006 |
| CN | 101093377 | A | 12/2007 |
| CN | 101165610 | A | 4/2008 |
| CN | 101192022 | A | 6/2008 |
| CN | 102902180 | A | 1/2013 |
| CN | 103293906 | A | 9/2013 |
| CN | 105518537 | A | 4/2016 |
| DE | S96 36 841 | T2 | 5/2007 |
| JP | H04-051259 | A | 2/1992 |
| JP | 2000-214667 | A | 8/2000 |
| JP | 2001-337568 | A | 12/2001 |
| JP | 2002-131995 | A | 5/2002 |
| JP | 2006-267528 | A | 10/2006 |
| JP | 2009-109527 | A | 5/2009 |
| JP | 2010-002771 | A | 1/2010 |
| JP | 2013-221974 | A | 10/2013 |
| JP | 2014-081602 | A | 5/2014 |
| KR | 95-25494 | A | 9/1995 |

OTHER PUBLICATIONS

Office Action issued in corresponding Chinese Patent Application No. 201810735625.0, dated Jan. 30, 2022.

* cited by examiner

IMAGE FORMING APPARATUS AND CONTROL METHOD THEREOF

CROSS REFERENCE TO RELATED APPLICATIONS

The present application is a continuation of U.S. patent application Ser. No. 17/233,964 filed on Apr. 19, 2021, which is a continuation of U.S. Pat. No. 11,009,821 which issued from U.S. patent application Ser. No. 16/869,722 filed on May 8, 2020, which is a continuation application of U.S. Pat. No. 10,671,002 which issued from U.S. patent application Ser. No. 16/027,439 filed on Jul. 5, 2018 and which claims priority from Japanese Patent Application No. 2017-133272, which was filed on Jul. 7, 2017, the disclosures of which are herein incorporated by reference in their entirety.

BACKGROUND

Technical Field

The following disclosure relates to an image forming apparatus including: a developing unit including a developing roller; and a developer cartridge storing developer.

Description of Related Art

There is known an image forming apparatus which includes: an image forming unit having a developing device; a developer cartridge removably mounted on the image forming unit; and a supplier configured to supply developer from the developer cartridge to the developing device. In the known apparatus, the developer is supplied from the developer cartridge to the developing device in accordance with use of the developer. Further, when the end of life of the image forming unit is detected, the developer stops being supplied from the developer cartridge to the developing device and a control is executed in which image formation is performed by the developer remaining in the developing device of the image forming unit. (The control will be hereinafter referred to as "use-up mode" where appropriate.) The use-up mode is selectable by a user's operation on an operation panel of the image forming apparatus.

SUMMARY

In the known technique, the use-up mode is executed with the developer cartridge kept mounted on the image forming unit, and there may arise a problem of unexpected execution of the use-up mode against a user's intention. In the case where the user makes an erroneous setting on the operation panel, the use-up mode is unintentionally executed, causing a risk of a deterioration in image quality and a malfunction of the developing device.

Accordingly, one aspect of the present disclosure relates to a technique of obviating erroneous execution of the use-up mode.

One aspect of the present disclosure provides an image forming apparatus, including: a printer housing; a photoconductor; a developing unit including a developing roller configured to form a developer image on the photoconductor; a developer cartridge storing developer, the developer cartridge being removably mountable on the printer housing, a supplier configured to supply the developer from the developer cartridge to the developing unit; and a controller configured to execute a first printing process of forming a developer image by use of the developer supplied from the developer cartridge, when the developer cartridge is being mounted on the printer housing, and a second printing process of forming a developer image by use of the developer remaining in the developing unit, when a usage amount of the developing unit is not less than a predetermined value and the developer cartridge is not being mounted on the printer housing, wherein the controller does not execute the second printing process when the usage amount of the developing unit is less than the predetermined value.

Another aspect of the present disclosure provides an image forming apparatus, including: a printer housing; a photoconductor; a developing unit including a developing roller configured to form a developer image on the photoconductor; a developer cartridge storing developer, the developer cartridge being removably mountable on the printer housing; a supplier configured to supply the developer from the developer cartridge to the developing unit; and a controller configured to execute a non-mount printing process of forming a developer image by use of the developer remaining in the developing unit when an index value that increases in accordance with use of the developing unit is not less than a predetermined value and the developer cartridge is not being mounted on the printer housing, wherein the controller does not execute the non-mount printing process when the index value that increases in accordance with use of the developing unit is less than the predetermined value.

Still another aspect of the present disclosure provides a control method of an image forming apparatus including a printer housing, a photoconductor, a developing unit including a developing roller configured to form a developer image on the photoconductor, a developer cartridge storing developer, the developer cartridge being removably mountable on the printer housing, and a supplier configured to supply the developer from the developer cartridge to the developing unit, the control method including: a first printing step in which, when the developer cartridge is being mounted on the printer housing, the developer is supplied by the supplier from the developer cartridge to the developing unit and a developer image is formed on the photoconductor; and a second printing step in which, when a usage amount of the developing unit is not less than a predetermined value and the developer cartridge is not being mounted on the printer housing, a developer image is formed on the photoconductor by the developer remaining in the developing unit, wherein execution of the second printing step is prohibited when the usage amount of the developing unit is less than the predetermined value.

BRIEF DESCRIPTION OF THE DRAWINGS

The objects, features, advantages, and technical and industrial significance of the present disclosure will be better understood by reading the following detailed description of an embodiment, when considered in connection with the accompanying drawings, in which.

DETAILED DESCRIPTION OF THE EMBODIMENT

Figure 1:
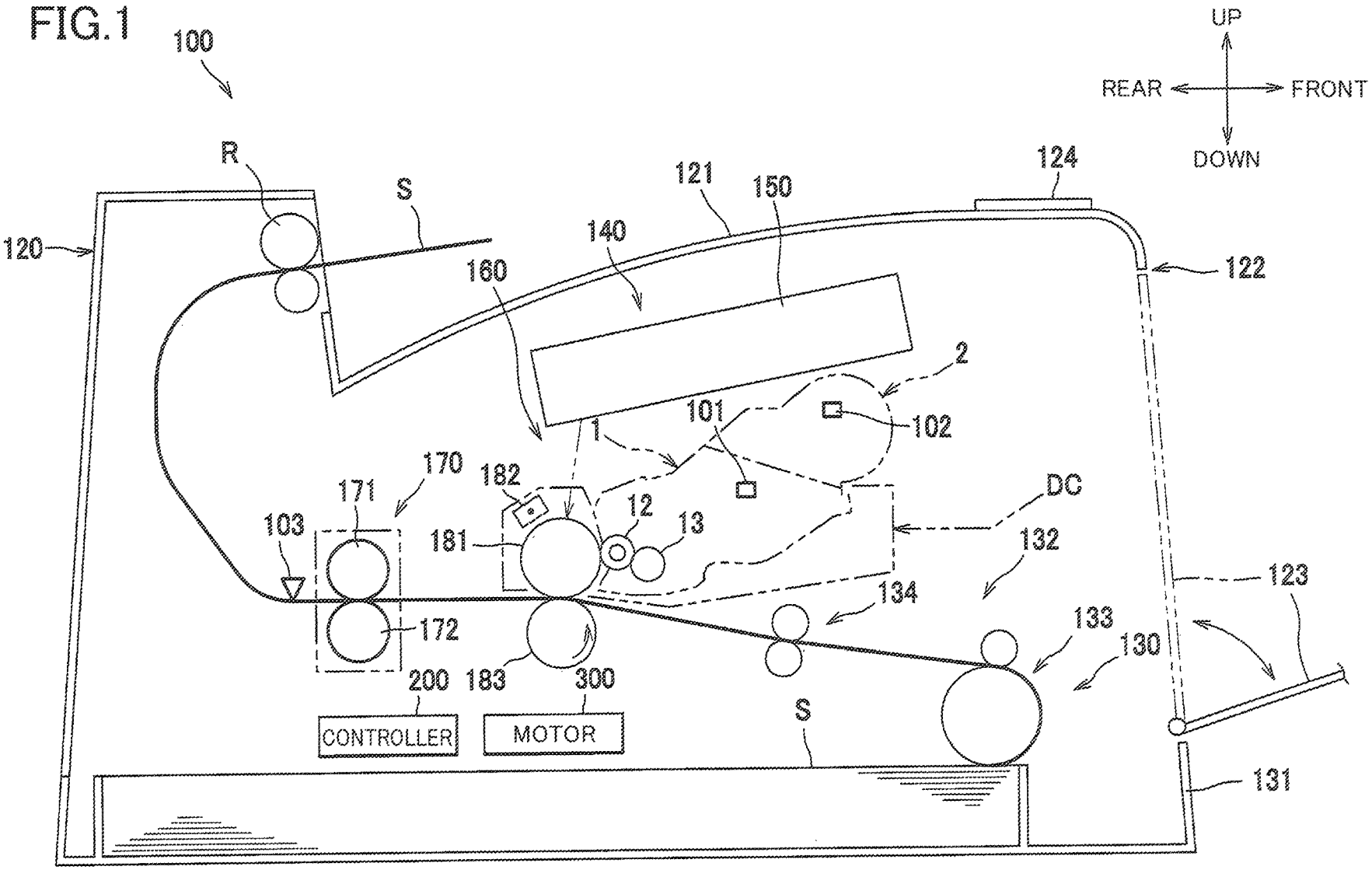
FIG. 1 is a view showing an overall structure of a laser printer according to one embodiment.

There will be explained in detail one embodiment referring to the drawings. In the following explanation, directions are defined based on directions indicated in FIG. 1. That is, a right side and a left side in FIG. 1 are respectively defined as a front side and a rear side, and a back side and a front side of the sheet of FIG. 1 are respectively defined as a right side and a left side. Further, an up-down direction in FIG. 1 is defined as an up-down direction.

As shown in FIG. 1, a laser printer 100 is an image forming apparatus including a printer housing 120, a feeder portion 130 configured to supply a sheet S, an image forming portion 140 configured to form an image on the sheet S, a controller 200, and a motor 300. A drive force of the motor 300 is transmitted to the feeder portion 130 and the image forming portion 140.

The feeder portion 130 includes a sheet supply tray 131 removably mounted on a lower portion of the printer housing 120 and a conveyor mechanism 132 configured to convey the sheet S in the sheet supply tray 131 toward a transfer roller 183. The conveyor mechanism 132 includes: a sheet supply mechanism 133 configured to separate the sheets S in the sheet supply tray 131 one by one and to convey the separated sheet S toward registration rollers 134; and the registration rollers 134 for properly positioning each position in the leading edge of the sheet S being conveyed.

The image forming portion 140 includes a scanner unit 150, a process cartridge 160, a transfer roller 183, and a fixing device 170.

The scanner unit 150 is provided in an upper portion of the printer housing 120. The scanner unit 150 is an exposing device including a laser light emitter, a polygon mirror, lenses, and reflective mirrors (not shown). In the scanner unit 150, a laser beam is applied to a surface of a photoconductor 181 (which will be explained) by high-speed scanning.

The process cartridge 160 includes a developing unit cartridge DC and a developer cartridge 2. The process cartridge 160 is mountable on and removable from the printer housing 120 through an opening 122 which is opened and closed by a front cover 123 pivotably provided on a front wall of the printer housing 120.

The developing unit cartridge DC includes the photoconductor 181, a charger 182, and a developing unit 1. The photoconductor 181 is a cylindrical photoconductor drum and rotatably held by a frame of the developing unit cartridge DC. The photoconductor 181 may be configured to be attachable to and removable from the developing unit cartridge DC.

The developer cartridge 2 is mountable on and removable from the developing unit 1. In other words, the developer cartridge 2 is mountable on and removable from the printer housing 120 together with the developing unit cartridge DC. The developing unit 1 and the developer cartridge 2 store single-component dry toner as developer. The developing unit 1 and the developer cartridge 2 will be later explained in detail.

The printer housing 120 is provided with a first sensor 101 configured to detect whether the developing unit cartridge DC is being mounted on the printer housing 120 and a second sensor 102, as one example of a sensor, for detecting whether the developer cartridge 2 is being mounted on the printer housing 120. The first sensor 101 and the second sensor 102 are optical sensors, for instance. Further, an operation panel 124, as one example of a setting device, is provided on an upper surface of the printer housing 120. It is possible to set, through the operation panel 124, whether a second printing process (which will be later explained) is allowed to be executed. The operation panel 124 may be a touch panel or may be constituted by a display screen and push buttons.

The fixing device 170 includes a heating roller 171 and a pressure roller 172 pressed onto the heating roller 171.

In the image forming portion 140, the surface of the photoconductor 181 that rotates is uniformly charged by the charger 182 and subsequently exposed to a high-speed scanning of a laser beam from the scanner unit 150. Thus, an electrostatic latent image based on image data is formed on the surface of the photoconductor 181.

Subsequently, the toner is supplied from the developing unit 1 to the electrostatic latent image on the photoconductor 181, so that a toner image is formed on the surface of the photoconductor 181. Thereafter, the sheet S is conveyed between the photoconductor 181 and the transfer roller 183, so that the toner image carried on the surface of the photoconductor 181 is transferred onto the sheet S. Then, in the fixing device 170, the toner transferred onto to the sheet S is thermally fixed between the heating roller 171 and the pressure roller 172.

A sheet sensor 103 is provided downstream of the fixing device 170 in a conveyance direction of the sheet S. The sheet sensor 103 is configured to detect passage of the sheet S discharged from the fixing device 170. The sheet sensor 103 includes, for instance, a swing lever configured to swing by being pushed by the sheet S that is being conveyed and an optical sensor configured to detect swinging of the swing lever. In the present embodiment, the sheet sensor 103 is in an ON state while the sheet S is passing, namely, while the swing lever is being laid down by the sheet S.

A discharge roller R is disposed downstream of the sheet sensor 103. The sheet S that has been subjected to thermal fixation of the toner by the fixing device 170 is conveyed to the discharge roller R and subsequently discharged onto a sheet discharge tray 121 from the discharge roller R.

Figure 2:
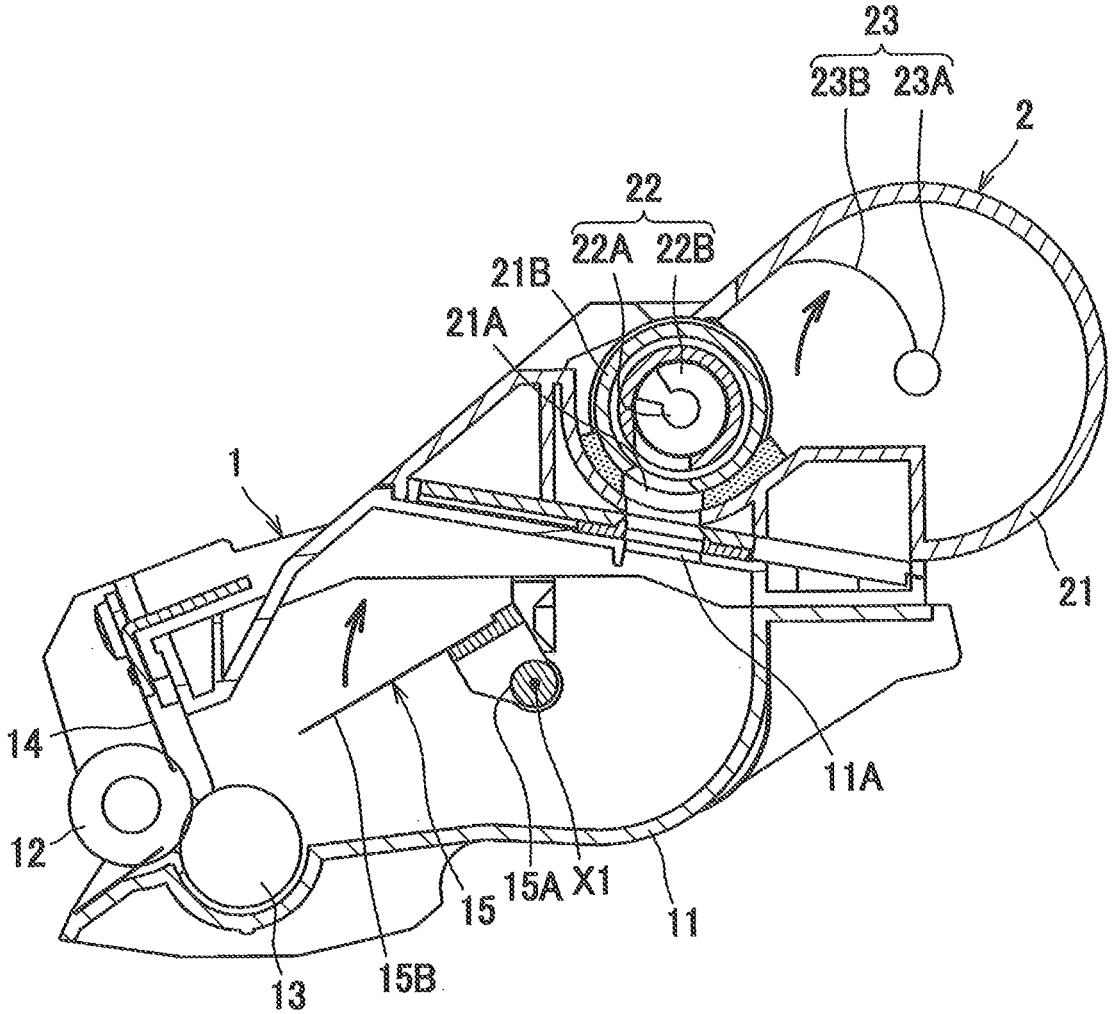
FIG. 2 is a cross-sectional view of a developing unit and a developer cartridge.

As shown in FIG. 2, the developing unit 1 includes a housing 11, a developing roller 12, a supply roller 13, a layer-thickness limiting blade 14, and a first agitator 15. The housing 11 stores the toner therein. The housing 11 supports the layer-thickness limiting blade 14 and rotatably supports the developing roller 12, the supply roller 13, and the first agitator 15.

The developing roller 12 is configured to supply the toner to the electrostatic latent image formed on the photoconductor 181. The developing roller 12 is rotatable about a rotation axis extending in a right-left direction.

The supply roller 13 is configured to supply, to the developing roller 12, the toner in the housing 11. The layer-thickness limiting blade 14 is a member for limiting a thickness of the toner on the developing roller 12.

The first agitator 15 includes: a shaft portion 15A rotatable about a first axis X1 which is a rotation axis parallel to the rotation axis of the developing roller 12; and an agitating blade 15B fixed to the shaft portion 15A. The housing 11 rotatably supports the shaft portion 15A. The agitating blade 15B is configured to rotate clockwise in FIG. 2 together with the shaft portion 15A, so as to agitate the toner in the housing 11.

The developer cartridge 2 includes: a housing 21 in which the toner is stored; an auger 22, as one example of a supplier, configured to supply the toner in the housing 21 to the developing unit 1; and a second agitator 23 configured to rotate clockwise in FIG. 2 so as to agitate the toner in the housing 21.

The auger 22 is rotatable about a rotation shaft 22A extending in the right-left direction. The auger 22 is configured to rotate so as to convey the toner in the housing 21 in the axial direction. Specifically, the auger 22 is a screw auger including the rotation shaft 22A and a plate 22B helically provided around the rotation shaft 22A. The plate 22B of the auger 22 is formed integrally with the rotation shaft 22A.

The housing 21 has an outlet 21A through which the toner in the housing 21 is supplied to the developing unit 1 and a toner conveyor portion 21B surrounding the auger 22. The housing 11 of the developing unit 1 has an inlet 11A which faces the outlet 21A and through which the toner is supplied from the outlet 21A. The outlet 21A and the inlet 11A are located below the auger 22 and on one end side of the auger 22 in the axial direction, specifically, on a downstream side in a conveyance direction of the toner conveyed by the auger 22. In this configuration, when the auger 22 rotates, the toner is conveyed toward the one end side in the axial direction by the helical plate 22B, so that the toner is supplied into the housing 11 through the outlet 21A and the inlet 11A.

The second agitator 23 includes a shaft portion 23A parallel to the right-left direction and an agitating blade 23B provided on the shaft portion 23A. The second agitator 23 is coupled to the auger 22 via a predetermined number of gears not shown.

To the auger 22, a drive force is input from a drive source provided on the printer housing 120. The controller 200 controls transmission and cutoff of the drive force to the auger 22. A mechanism for transmitting the drive force from the drive source to the auger 22 may be configured as follows, for instance. In a configuration in which the drive force is transmitted from the drive source to the developing unit 1, the drive force transmitted to the developing unit 1 may be transmitted to the auger 22 via a clutch mechanism. In this case, the controller 200 is configured to control connection and disconnection of the clutch mechanism, thereby enabling transmission and cutoff of the drive force to the auger 22.

The controller 200 includes a CPU, a RAM, a ROM, a nonvolatile memory, an ASIC, and an input/output circuit. The controller 200 executes control by executing various arithmetic processing based on a print instruction output from an external computer, signals output from the sensors 101-103, and programs and data stored in the ROM, for instance. The controller 200 is configured to execute a developing process, a usage-amount obtaining process, a first printing process, a second printing process, a cartridge confirming process, and an error displaying process.

The developing process is a process of developing an electrostatic latent image on the photoconductor 181. Specifically, in a state in which an appropriate voltage is applied to the developing roller 12, the controller 200 executes an exposure process of blinking a laser beam scanned by the scanner unit 150 based on the image data in accordance with the print instruction.

The usage-amount obtaining process is a process of obtaining a toner usage amount Qu which is a usage amount of the toner in the developing process. In the usage-amount obtaining process, the controller 200 counts, by a dot counter, the number of dots of the image data in accordance with the print instruction.

In the case where the number of dots per unit area is not greater than a predetermined value, the number of dots may be regarded as the predetermined value. In a toner saving mode, for instance, the toner usage amount Qu may be calculated so as to be smaller by multiplying the number of dots by a coefficient less than 1.

The controller 200 has a function of executing the usage-amount obtaining process after a toner image corresponding to an image for one sheet S (for one page of the sheet S) has been formed on the photoconductor 181 in the developing process. Specifically, in the present embodiment, the controller 200 executes the usage-amount obtaining process after the state of the sheet sensor 103 has been switched from ON to OFF, namely, after the sheet S has passed through the fixing device 170.

The first printing process is a process in which, when the developer cartridge 2 is being mounted on the printer housing 120, the toner is supplied by the auger 22 from the developer cartridge 2 to the developing unit 1 and an image is formed on the sheet S. In other words, the controller 200 executes the first printing process of forming an image (developer image) by use of the toner supplied from the developer cartridge 2 when the developer cartridge 2 is being mounted on the printer housing 120. In the first printing process, the controller 200 executes a supplying process of supplying the toner from the developer cartridge 2 to the developing unit 1 by driving the auger 22 in accordance with use of the toner. Specifically, the controller 200 executes the supplying process when an increase amount Qu1 of the toner usage amount Qu from a time point of execution of a preceding supplying process up to a current time point becomes equal to or greater than a threshold TH1.

The controller 200 has a function of supplying a predetermined amount of the toner to the developing unit 1 in the supplying process. In the supplying process, the controller 200 causes the auger 22 to rotate a predetermined number of times. Specifically, in the supplying process, the controller 200 causes the auger 22 to rotate at a predetermined rotational speed for a predetermined length of time.

In the present embodiment, the increase amount Qu1 of the toner usage amount Qu is updated to a value obtained by subtracting the threshold TH1 every time the supplying process is executed. Further, the toner usage amount Qu is counted as a total toner usage amount Qus and reset to an initial value every time the developer cartridge 2 is replaced.

The second printing process is a process in which an image is formed on the sheet S by the toner remaining in the developing unit 1 when a usage amount of the developing unit 1 is not less than a predetermined threshold and the developer cartridge 2 is not being mounted on the printer housing 120. In other words, the controller 200 executes the second printing process of forming an image (developer image) by use of the toner remaining in the developing unit 1 when the usage amount of the developing unit 1 is not less than the predetermined threshold and the developer cartridge 2 is not being mounted on the printer housing 120. That is, the second printing process is a process for using up the toner remaining in the developing unit 1 when the usage amount of the developing unit 1 reaches a value corresponding to an end of its life. In the following explanation, the second printing process will be also referred to as a use-up mode where appropriate. When the usage amount of the developing unit 1 is not less than the predetermined threshold, the first printing process may be prohibited from being executed.

In the present embodiment, the number of rotations Nd of the developing roller 12 is illustrated as one example of the usage amount of the developing unit 1. With an increase in the number of rotations Nd counted from a brand-new state of the developing roller 12, wear of the developing roller 12 and the layer-thickness limiting blade 14 proceeds, making it difficult to maintain the quality of a printed image. In the present embodiment, the controller 200 determines that the usage amount of the developing unit 1 is not less than the threshold, namely, the developing unit 1 reaches the end of its life, when the number of rotations Nd of the developing roller 12 is not less than a first threshold N1. Further, the controller 200 has a function of notifying that the developing unit 1 needs to be replaced when the usage amount of the developing unit 1 is not less than the predetermined threshold.

In the second printing process, the controller 200 has a function of stopping an operation of the auger 22, specifically, a function of prohibiting transmission of the drive force to the auger 22. Further, the controller 200 is configured not to execute the usage-amount obtaining process and the supplying process in the second printing process.

The controller 200 has a function of enabling the second printing process to be executed on condition that execution of the second printing process is allowed through the operation panel 124. In other words, the controller 200 is configured to execute a setting accepting process of accepting a setting as to whether the execution of the second printing process is allowed and to execute the second printing process when a setting to allow the execution of the second printing process is being established. The controller 200 has a function of prohibiting the execution of the second printing process on condition that a developing unit cartridge DC whose usage amount is less than the predetermined threshold is mounted after the second printing process has been executed. The present embodiment illustrates, as the developing unit cartridge DC whose usage amount is less than the predetermined threshold, a brand-new developing unit cartridge DC, namely, a developing unit cartridge DC in which the number of rotations Nd of the developing roller 12 is 0.

The cartridge confirming process is a process for confirming a state of each of the developer cartridge 2 and the developing unit cartridge DC as consumables. In the cartridge confirming process, the controller 200 mainly sets, to 1, error flags (which will be later explained) depending upon the state of the developer cartridge 2 and the state of the developing unit cartridge DC.

The error displaying process is a process of displaying, on the operation panel 124, a message corresponding to the kind of the error flag. In the error displaying process, the controller 200 is configured to display a message to permit the user to select the second printing process, i.e., "use-up mode".

There will be next explained an operation of the controller 200 in detail.

Figure 3:
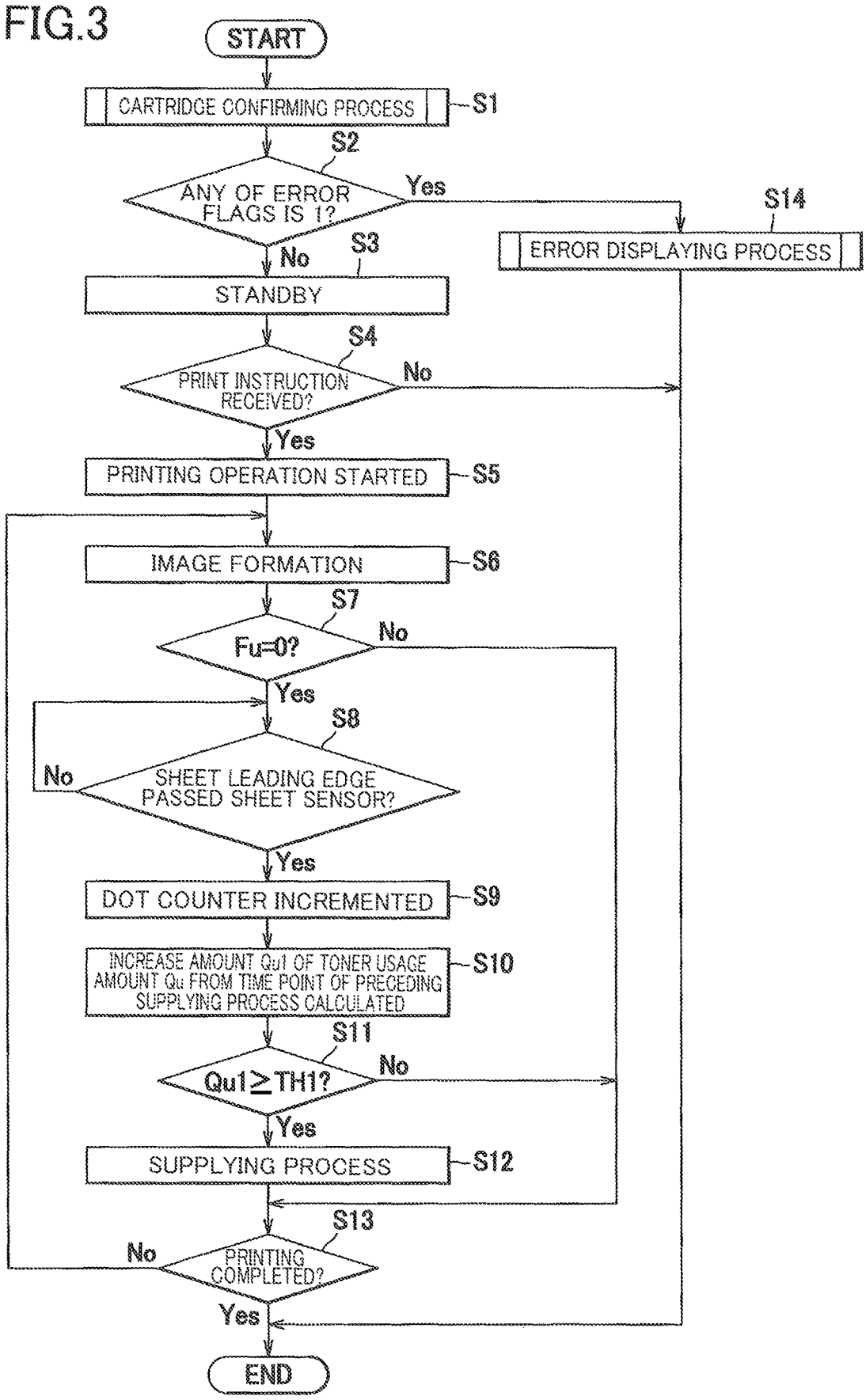
FIG. 3 is a flowchart showing an operation of a controller.

In response to turn-on of the laser printer 100 or in response to closing of the front cover 123, the controller 200 starts a control shown in the flow chart of FIG. 3. The controller 200 repeatedly executes the control of FIG. 3 in a period in which the laser printer 100 is kept turned ON.

Figure 4:
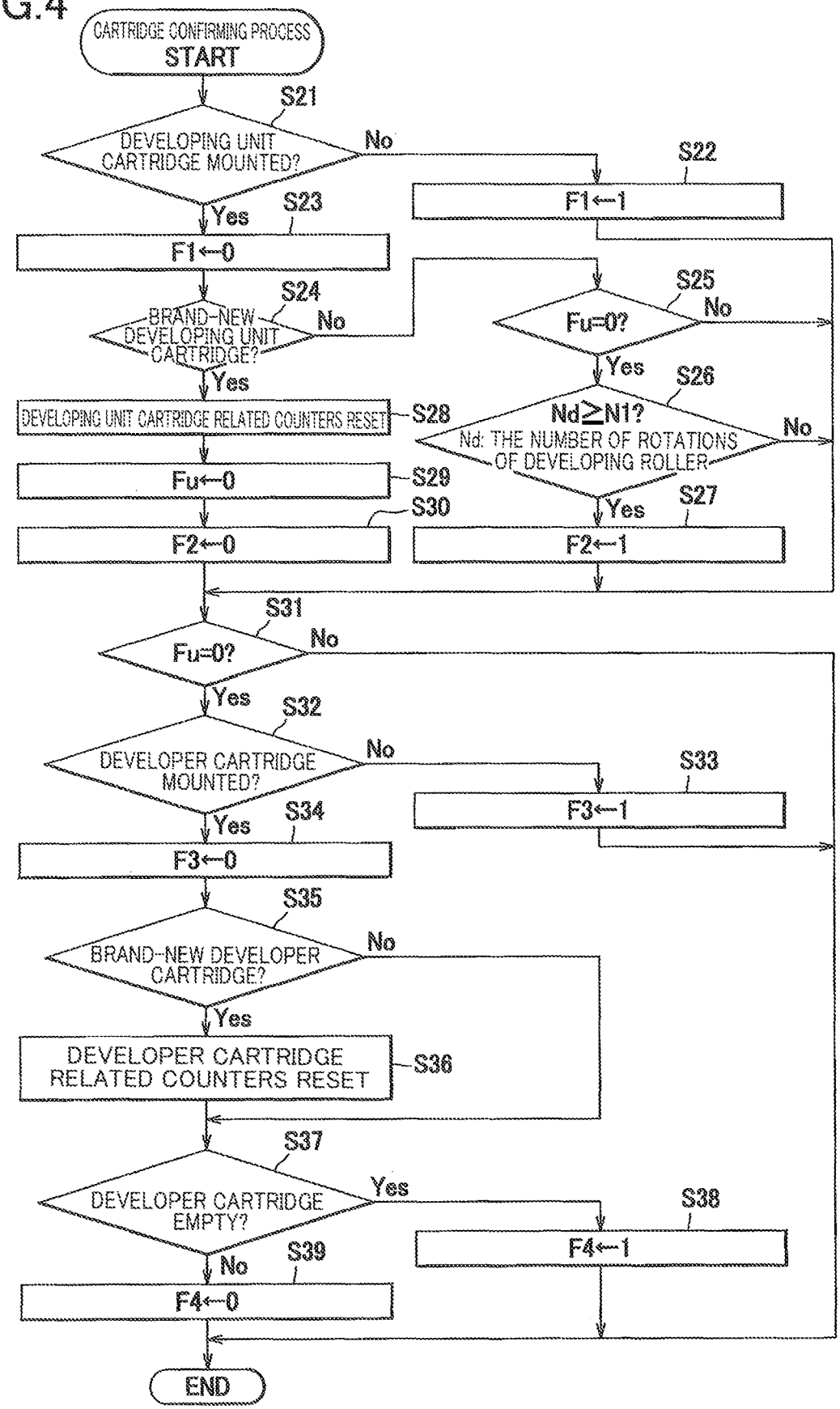
FIG. 4 is a flowchart showing a cartridge confirming process.

In the control of FIG. 3, the controller 200 executes the cartridge confirming process (S1). As shown in FIG. 4, in the cartridge confirming process, the controller 200 initially determines whether the developing unit cartridge DC is being mounted on the printer housing 120 (S21).

When it is determined at S21 that the developing unit cartridge DC is not being mounted (No), the controller 200 sets a drum non-mount flag F1 to 1, the drum non-mount flag F1 indicating that the developing unit cartridge DC is not being mounted (S22). On the other hand, when it is determined at S21 that the developing unit cartridge DC is being mounted (Yes), the controller 200 sets the drum non-mount flag F1 to 0 (S23).

After S23, the controller 200 determines whether the developing unit cartridge DC currently mounted on the printer housing 120 is brand new (S24). The determination as to whether the developing unit cartridge DC is brand new may be made based on information in a memory provided in the developing unit cartridge DC, for instance. Alternatively, the determination may be made such that a movable member movable between a brand-new cartridge position and a used cartridge position is provided for the developing unit cartridge DC and a position of the movable member is detected by a sensor provided in the printer housing 120, for instance.

When it is determined at S24 that the developing unit cartridge DC is not brand new (No), the controller 200 determines whether a use-up flag Fu is 0 (S25), the use-up flag Fu indicating that the use-up mode is selected by a user. When it is determined at S25 that the use-up flag Fu is 0 (Fu=0), namely, the use-up mode is not selected (Yes), the controller 200 determines whether the number of rotations Nd of the developing roller 12 is not less than the first threshold N1, so as to determine whether the developing unit cartridge DC is at the end of its life, specifically, whether the developing unit 1 is at the end of its life (S26).

When it is determined at S26 that the number of rotations Nd of the developing roller 12 is not less than the first threshold N1 (Nd≥N1), the controller 200 sets a life flag F2 to 1 (S27), the life flag F2 indicating that the developing unit cartridge DC is at the end of its life. When it is determined at S24 that the developing unit cartridge DC is brand new (Yes), the controller 200 resets counters related to the developing unit cartridge DC (S28). Specifically, at S28, the controller 200 resets a counter for counting the number of rotations Nd of the developing roller 12, for instance.

After S28, the controller 200 sets the use-up flag Fu and the life flag F2 to 0 (S29, S30). After S30, S27, S22 or when a negative determination is made at S25, S26, the controller 200 determines whether the use-up flag Fu is 0 (S31).

When it is determined at S31 that the use-up flag Fu is 0 (Fu=0) (Yes), the controller 200 determines whether the developer cartridge 2 is being mounted on the printer housing 120 via the developing unit cartridge DC (S32). When it is determined at S32 that the developer cartridge 2 is not being mounted (No), the controller 200 sets a box non-mount flag F3 to 1 (S33), the box non-mount flag F3 indicating that the developer cartridge 2 is not being mounted.

When it is determined at S32 that the developer cartridge 2 is being mounted (Yes), the controller 200 sets the box non-mount flag F3 to 0 (S34). After S34, the controller 200 determines whether the developer cartridge 2 is brand new (S35). The determination as to whether the developer cartridge 2 is brand new may be made in a manner similar to that in the determination as to whether the developing unit cartridge DC is brand new. That is, the determination may be made based on information in a memory provided in the developer cartridge 2, for instance. Alternatively, the determination may be made such that a movable member configured to be movable between a brand-new cartridge position and a used cartridge position is provided for the developer cartridge 2 and a position of the movable member may be detected by a sensor provided in the printer housing 120.

When it is determined at S35 that the developer cartridge 2 is brand new (Yes), the controller 200 resets counters related to the developer cartridge 2 (S36). Specifically, at S36, the controller 200 resets a counter for counting the total toner usage amount Qus, for instance.

After S36 or a negative determination (No) is made at S35, the controller 200 determines whether the developer cartridge 2 is empty (S37). For instance, the determination as to whether the developer cartridge 2 is empty may be made by determining whether the total toner usage amount Qus is not less than a predetermined threshold. Alternatively, the determination may be made based on a detection result by a sensor configured to detect a toner amount in the developer cartridge 2.

When it is determined at S37 that the developer cartridge 2 is empty (Yes), the controller 200 sets an empty flag F4 to 1 (S38), the empty flag F4 indicating that the developer cartridge 2 is empty. On the other hand, when it is determined at S37 that the developer cartridge 2 is not empty (No), the controller 200 sets the empty flag F4 to 0 (S39). After S38, S39, S33, the controller 200 ends the present control.

Returning back to FIG. 3, after the cartridge confirming process, the controller 200 determines whether any of the error flags is 1 (S2). Specifically, the controller 200 determines at S2 whether any of the flags F1-F4 is 1.

When it is determined at S2 that any of the error flags is 1 (Yes), the controller 200 executes the error displaying process (S14). In the error displaying process shown in FIG. 5, the controller 200 initially determines whether the life flag F2 is 1 (S51). When it is determined at S51 that the life flag F2 is not 1 (No), the controller 200 displays, on the operation panel 124, a message corresponding to the kind of the error flag currently set at 1 (S52). In the case where the drum non-mount flag F1, as the error flag, is 1, for instance, the controller 200 displays, on the operation panel 124, a message indicating that the developing unit cartridge DC is not being mounted, e.g., a message saying "Developing unit cartridge DC is not being mounted".

When it is determined at S51 that the life flag F2 is 1 (F2=1) (Yes), the controller 200 displays, on the operation panel 124, a message to prompt the user to replace the developing unit cartridge DC and a message that the use-up mode is executable (S53). Specifically, in the case where the operation panel 124 is a touch panel, for instance, the controller 200 displays, on the screen, a button for executing the use-up mode.

After S53, the controller 200 determines whether the use-up mode is selected based on a signal from the operation panel 124 (S54). When it is determined at S54 that the use-up mode is selected (Yes), the controller 200 sets the use-up flag Fu to 1 (S55) and determines whether the developer cartridge 2 is mounted (S56).

When it is determined at S56 that the developer cartridge 2 is being mounted, namely, an affirmative determination (Yes) is made at S56, the controller 200 displays, the operation panel 124, an error message indicating that the developer cartridge 2 is being mounted (S57). Specifically, the controller 200 displays, on the operation panel 124, an error message saying "Remove the developer cartridge 2 from the developing unit cartridge DC for execution of the use-up mode.", for instance.

When it is determined at S56 that the developer cartridge 2 is not being mounted, namely, a negative determination (No) is made at S56, the controller 200 sets the life flag F2 to 0 so as to clear the error flag (S58). After S58, S57, S52 or when a negative determination (No) is made at S54, the controller 200 ends the present control.

Returning back to FIG. 3, when the controller 200 determines at S2 that no error flags are 1 (No), the controller 200 executes a standby process (S3). In the standby process, the controller 200 controls the agitators 15, 23 to rotate or controls the temperature of the heating roller 171 to rise to a standby temperature lower than the temperature in printing.

After S3, the controller 200 determines whether a print instruction is received (S4). When it is determined at S4 that the print instruction is received (Yes), the controller 200 starts a printing operation (S5). After S5, the controller 200 executes an image forming process in which an image is formed on the sheet S (S6).

After S6, the controller 200 determines whether the use-up flag Fu is 0 (S7). When it is determined at S7 that the use-up flag Fu is 0 (Fu=0) (Yes), the controller 200 determines whether a leading edge of the sheet S has passed the sheet sensor 103 (S8).

When it is determined at S8 that the leading edge of the sheet S has passed the sheet sensor 103 (Yes), the controller 200 increments the dot counter (S9). After S9, the controller 200 calculates the increase amount Qu1 of the toner usage amount Qu from the time point of the preceding supplying process (S10).

After S10, the controller 200 determines whether the increase amount Qu1 is not less than the threshold TH1 (S11). When it is determined at S11 that the increase amount Qu1 is not less than the threshold TH1 (Qu1≥TH1) (Yes), the controller 200 executes the supplying process in which the toner in the developer cartridge 2 is supplied to the developing unit 1 (S12).

After S12 or when a negative determination is made at S11, S7, the controller 200 determines whether printing of the number of pages instructed in the print instruction has been completed (S13).

When it is determined at S13 that printing is not yet completed (No), the control flow returns to S6. When it is determined at S13 that printing has completed (Yes), when a negative determination (No) is made at S4, or after S14, the controller 200 ends the present control.

There will be next explained an example of the operation of the controller 200. In an initial state in the following explanation, each of the flags is set at 0.

When a brand-new process cartridge 160 is mounted on the printer housing 120 and the front cover 123 is closed, the controller 200 ends the cartridge confirming process shown in FIGS. 3 and 4 without setting any of the error flags to 1 in the cartridge confirming process. Accordingly, the controller 200 makes a negative determination (No) at S2 and proceeds to S3 and then to S4. When it is determined at S4 that the print instruction is received (Yes), the controller 200 executes the first printing process shown in S5-S13.

When the number of rotations Nd of the developing roller 12 becomes equal to or greater than the first threshold N1 after long-term use of the process cartridge 160, the controller 200 makes an affirmative determination (Yes) at S26 in the cartridge confirming process and sets the life flag F2 to 1 (S27). After S27, the controller 200 executes processes in the order of S31: Yes, S32: Yes, S34, S35: No, S37: No, and S39. Thus, the controller 200 ends the cartridge confirming process.

Figure 5:
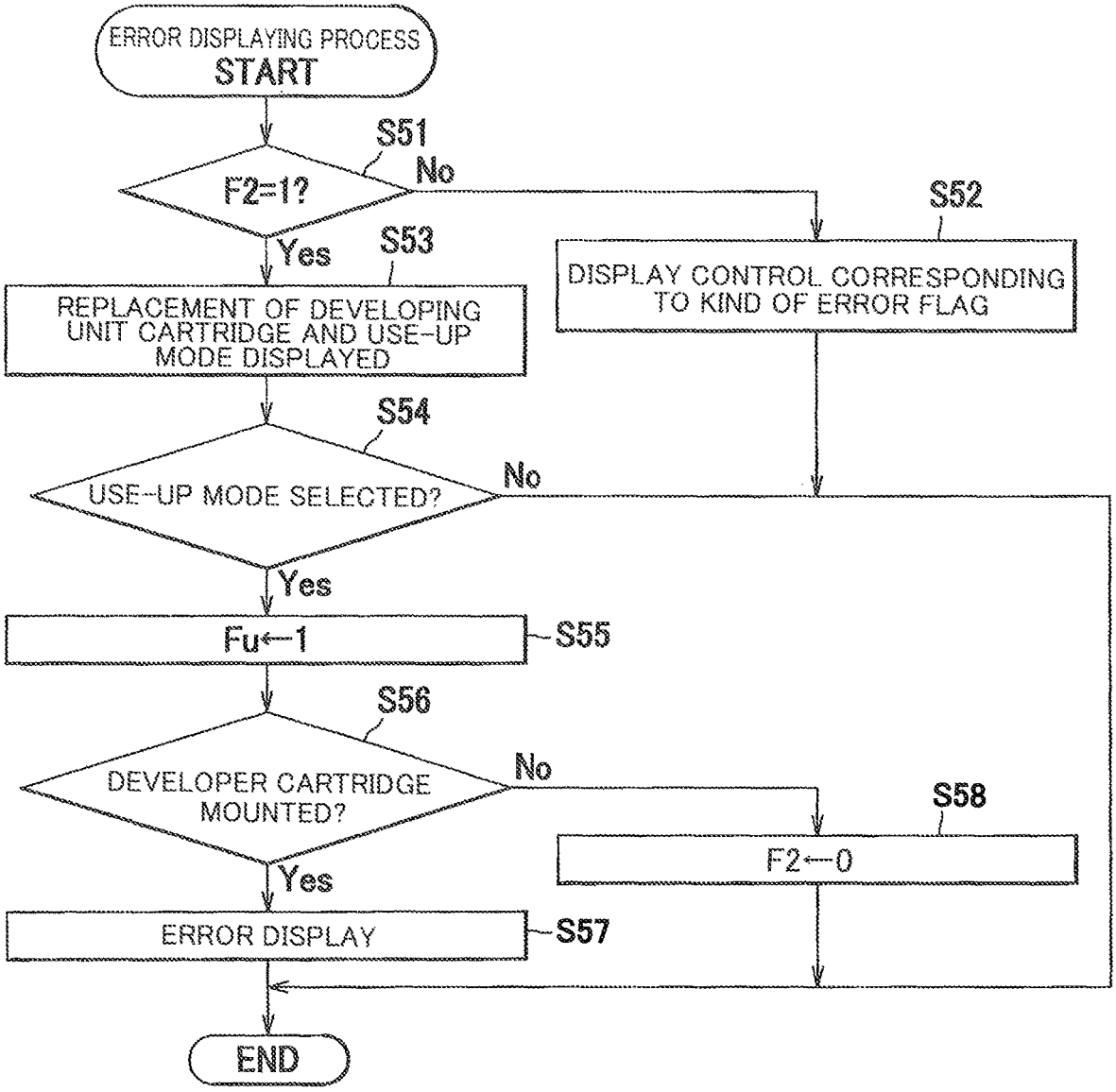
FIG. 5 is a flowchart showing an error displaying process.

When the life flag F2 is set to 1 in the cartridge confirming process, the controller 200 makes an affirmative decision (Yes) at S2 in FIG. 3 and executes the error displaying process (S14). As shown in FIG. 5, in the error displaying process, the controller 200 makes an affirmative decision (Yes) at S51 and displays, on the operation panel 124, the message to prompt the user to replace the developing unit cartridge DC and the message indicating that the use-up mode is executable (S53).

When the user selects the use-up mode by an operation on the operation panel 124, the controller 200 makes an affirmative determination (Yes) at S54 and sets the use-up flag Fu to 1 (S55). After S55, the controller 200 determines whether the developer cartridge 2 is not being mounted (S56). When the developer cartridge 2 is kept mounted on the developing unit cartridge D, the controller 200 makes a negative determination (No) at S56 and displays, on the operation panel 124, the message prompting the user to remove the developer cartridge 2 (S57).

The user prompted by the message opens the front cover 123, removes the process cartridge 160 from the printer housing 120, and removes the developer cartridge 2 from the developing unit cartridge DC. The user thereafter mounts only the developing unit cartridge DC on the printer housing 120 and closes the front cover 123.

In response to closing of the front cover 123, the controller 200 again starts the control shown in FIG. 3 and executes the cartridge confirming process (S1). In the cartridge confirming process, the controller 200 executes processes in the order of S21: Yes, S23, and S24: No. Thereafter, the controller 200 makes a negative determination (No) at both of S25 and S31 because the use-up flag Fu is being set at 1. Thus, the cartridge confirming process is ended. In this case, S32-S39 are skipped because of negative determination (No) at S31, so that the box non-mount flag F3 is not set to 1 at S33. In the use-up mode, therefore, printing can be performed even in a state in which the developer cartridge 2 is not mounted.

As shown in FIG. 3, after the cartridge confirming process, the controller 200 proceeds to S2. Because the life flag F2 is kept at 1, the controller 200 makes an affirmative determination (Yes) at S2 and executes the error displaying process (S14). As shown in FIG. 5, in the error displaying process, the controller 200 executes processes in the order of S51: Yes and S53. When the user selects the use-up mode, the controller 200 proceeds to S56 after execution of processes in the order of S54: Yes and S55. Because the developer cartridge 2 is already removed from the developing unit cartridge DC, the controller 200 makes an affirmative decision (Yes) at S56 and sets the life flag F2 back to 0 so as to clear the error flag (S58).

The life flag F2 is set back to 0 in the error displaying process, so that the controller 200 makes a negative determination (No) at S2 in FIG. 3. Subsequently, the controller 200 proceeds to S3 and then to S4. When it is determined at S4 that the print instruction is received (Yes), the controller 200 proceeds to S5 and then to S6. Subsequently, the controller 200 proceeds to S7.

On this occasion, because the use-up flag Fu is 1, the controller 200 makes a negative determination (No) at S7 and proceeds to S13. That is, when the use-up flag Fu is 1, the controller 200 executes a second printing process shown in S5-S7, and S13, namely, the use-up mode. Thus, the toner remaining in the developing unit 1 can be efficiently used up.

The present embodiment offers the following advantageous effects.

On condition that the developer cartridge 2 is not being mounted, an image is formed by the toner remaining in the developing unit 1, namely, the use-up mode is executed, thereby preventing or reducing erroneous execution of the use-up mode. When the use-up mode is executed, there may be caused some troubles. For instance, the print quality may be deteriorated due to shortage of the toner or the wear of the developing roller 12 and the layer-thickness limiting blade 14 may rapidly proceed. In the present embodiment, the use-up mode is executed by user's operations to remove the developer cartridge 2 and mount only the developing unit cartridge DC. Thus, a shift to the use-up mode is clear by the user's intention.

Owing to provision of the second sensor 102 configured to detect whether the developer cartridge 2 is being mounted on the printer housing 120, it is possible to appropriately determine, based on the signal from the second sensor 102, whether the developer cartridge 2 is being mounted.

On condition that the execution of the second printing process is allowed by the operation panel 124, the second printing process becomes executable. In other words, when a setting to allow the execution of the second printing process is being established, the controller 200 executes the second printing process. In this configuration, the second printing process is executed only when the user explicitly allows the second printing process to be executed, preventing the second printing process from being unintentionally executed.

On condition that the developing unit cartridge DC in a brand-new state is mounted, the use-up flag Fu is set to 0, namely, the second printing process is prohibited from being executed. This configuration prevents or reduces an adverse influence on the bran-new developing unit cartridge DC which would be caused if the second printing process were executed with the brand-new developing unit cartridge DC mounted.

It is to be understood that the present disclosure is not limited to the details of the illustrated embodiment but may be embodied otherwise as described below. In the following explanation, the same reference signs as used in the illustrated embodiment are used to identify components and steps similar to those in the illustrated embodiment, and a detailed explanation thereof is dispensed with.

In the illustrated embodiment, when the developing unit cartridge DC in a brand-new state, namely, the developing unit 1 in a brand-new state, is mounted, the use-up flag Fu is set to 0 (S29) and the second printing process is prohibited. The present disclosure is not limited to this configuration. The controller 200 may be configured to prohibit the execution of the second printing process on condition that the developing unit 1 whose usage amount is less than the predetermined threshold is mounted on the printer housing 200. In the case where the developing unit 1 is equipped with a memory and includes a counter for counting the usage amount, the second printing process may be prohibited when the developing unit 1 the life of which still remains is mounted upon replacement.

Figure 6:
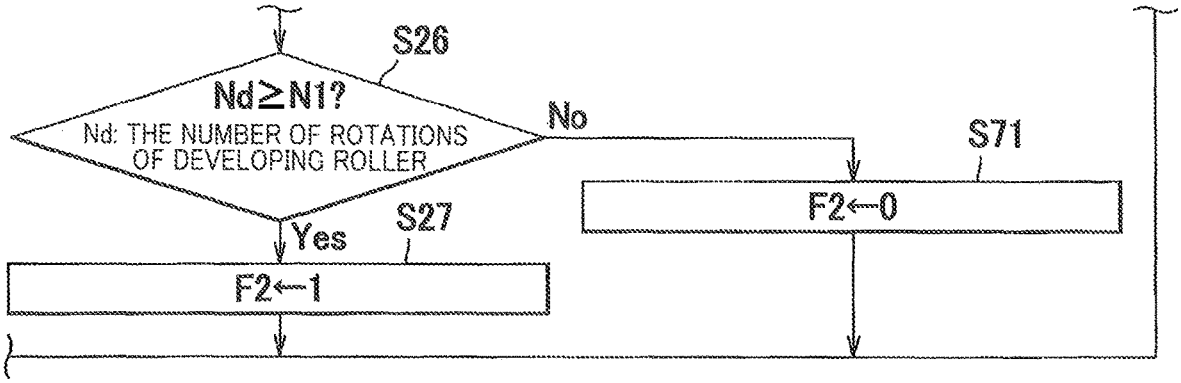
FIG. 6 is a flowchart showing a part of the cartridge confirming process according to a modification.

Specifically, S71 shown in FIG. 6 may be added to the flowchart of FIG. 4. FIG. 6 illustrates a portion around S26 in the cartridge confirming process shown in FIG. 4. In this modification, when the controller 200 makes a negative determination (No) at S26, the controller 200 executes S71. At S71, the controller 200 sets the life flag F2 to 0. After S71, the controller 200 proceeds to S31 in FIG. 4.

In the illustrated embodiment, the controller 200 is configured to determine that the usage amount of the developing unit 1 is not less than the predetermined threshold when the number of rotations Nd of the developing roller 12 is not less than the first threshold N1. The present disclosure is not limited to this configuration. In other words, in the illustrated embodiment, the number of rotations Nd of the developing roller 12 is set as one example of an index value that increases in accordance with use of the developing unit 1, and it is determined whether the usage amount of the developing unit 1 is not less than the predetermined threshold based on the number of rotations Nd. The index value is not limited to the number of rotations Nd. For instance, the number of printed pages in the developing unit 1 currently being mounted on the printer housing 120 may be set an one example of the index value that increases in accordance with use of the developing unit 1, and the controller 200 may be configured to determine that the usage amount of the developing unit 1 is not less than the predetermined threshold when the number of printed pages in the developing unit 1 is not less than a second threshold. Further, a print time in the developing unit 1 currently being mounted on the printer housing 120 or a drive time of a motor for driving the developing unit 1 may be set as one example of the index value that increases in accordance with use of the developing unit 1, and the controller 200 may be configured to determine that the usage amount of the developing unit 1 is not less than the predetermined threshold when the print time in the developing unit 1 is not less than a third threshold. Thus, the usage amount of the developing unit 1 may be construed as the index value that increases in accordance with use of the developing unit 1. Further, the usage amount of the developing unit 1 may be construed as one example of an index value which increases or decreases in accordance with use of the developing unit 1 and which is used for determining a replacement timing of the developing unit 1. In this respect, the determination at S26 may be made based on whether the index value for determining the replacement timing of the developing unit 1 is larger or smaller than a value set in advance.

In the case where the developing unit 1 and the developing unit cartridge DC are constituted as one component as in the illustrated embodiment, the controller 200 may be configured to determine that the usage amount of the developing unit 1 is not less than the predetermined threshold when the number of rotations of the photoconductor 181 is not less than a fourth threshold.

In the illustrated embodiment, the operation panel 124 is illustrated as one example of the setting device. The present disclosure is not limited to this configuration. For instance, the setting device may be an external device such as a computer configured to output the print instruction to the laser printer 100.

In the illustrated embodiment, as one example of the developer cartridge, the developer cartridge 2 mountable on and removable from the printer housing 120 indirectly via developing unit cartridge DC is illustrated. The present disclosure is not limited to this configuration. For instance, the developer cartridge may be directly mountable on and removable from the printer housing 120.

While the present disclosure is applied to the laser printer 100 in the illustrated embodiment, the present disclosure may be applied to other image forming apparatus such as a copying machine and a multi-function peripheral (MFP).

In the illustrated embodiment, the sheet S such as thick paper, a post card, or thin paper is illustrated as one example of the sheet. The sheet may be an OHP sheet.

In the illustrated embodiment, the photoconductor 181 is a cylindrical photoconductor drum. The photoconductor 181 may be a belt-like photoconductor.

The elements explained in the illustrated embodiment and the modification may be suitable combined.

What is claimed is:

1. An image forming apparatus, comprising:

a printer housing;

a photoconductor drum provided in the printer housing;

a developing unit provided in the printer housing, the developing unit including a developing roller configured to form a toner image on the photoconductor drum and a developing unit housing storing toner, the developing unit allowing a toner housing storing toner to be mounted, the developing unit having an inlet through which toner is supplied into the developing unit housing from an outlet of the toner housing;

a transfer roller configured to transfer the toner image formed on the photoconductor drum on a sheet; and a controller configured to execute a printing process of printing an image on the sheet, wherein, in a state in which the toner housing is not mounted on the developing unit, the controller executes the printing process in which the image is printed on the sheet by using remaining toner remained in the developing unit housing.

2. The image forming apparatus according to claim 1, wherein, when it is detected that the toner housing is not mounted on the developing unit, the controller executes the printing process in which the image is printed on the sheet by using remaining toner remained in the developing unit housing.

3. The image forming apparatus according to claim 1, further comprising a sensor configured to detect whether the toner housing is mounted on the developing unit.

4. The image forming apparatus according to claim 3, wherein the sensor is an optical sensor.

5. The image forming apparatus according to claim 1, wherein the inlet of the developing unit opens upward.

6. The image forming apparatus according to claim 1, further comprising an agitator configured to agitate the toner in the developing unit housing, wherein the inlet of the developing unit is located on an opposite side of an rotation axis of the agitator from the developing roller.

7. The image forming apparatus according to claim 1, wherein, in a state in which the toner housing is not mounted on the developing unit, the controller is configured to execute the printing process by a use-up mode printing of printing the image on the sheet, the use-up mode printing being a mode of printing of using up remaining toner remained in the developing unit housing that reaches the end of its life.

8. The image forming apparatus according to claim 7, wherein the controller is configured to execute the printing process by the use-up mode printing when a usage amount of the developing unit is equal to or greater than a predetermined value, and the controller is configured not to execute the printing process by the use-up mode printing when the usage amount of the developing unit is less than the predetermined value.

9. The image forming apparatus according to claim 1, wherein the developing unit uses single-component dry toner as the toner.

10. A developing unit for an image forming apparatus, comprising:

a developing roller configured to form a toner image on a photoconductor drum; and a developing unit housing storing toner, the developing unit allowing a toner housing storing toner to be mounted, the developing unit having an inlet through which the toner is supplied into the developing unit housing from an outlet of the toner housing, wherein, in a state in which the toner housing is mounted on the developing unit, the developing unit allows the toner in the toner housing to be supplied to the developing unit housing, and wherein, in a state in which the toner housing is not mounted on the developing unit, the developing unit allows the image forming apparatus to print an image on a sheet by using remaining toner remained in the developing unit.

11. The developing unit according to claim 10, wherein the inlet of the developing unit opens upward.

12. The developing unit according to claim 10, further comprising an agitator configured to agitate the toner in the developing unit housing, wherein the inlet of the developing unit is located on an opposite side of an rotation axis of the agitator from the developing roller.

13. The developing unit according to claim 10, wherein the developing unit uses single-component dry toner as the toner.

14. An image forming apparatus, comprising:

a printer housing;

a photoconductor drum provided in the printer housing;

a developing unit provided in the printer housing, the developing unit including a developing roller configured to form a toner image on the photoconductor drum and a developing unit housing storing toner, the developing unit having an inlet capable of facing an outlet of a toner housing storing toner;

a transfer roller configured to transfer the toner image formed on the photoconductor drum on a sheet; and a controller configured to execute a printing process of printing an image on the sheet, wherein, in a state in which the inlet of the developing unit and the outlet of the toner housing face each other, toner is capable of being supplied into the developing unit housing from the toner housing, and wherein, in a state in which the inlet of the developing unit and the outlet of the toner housing do not face each other, the controller executes the printing process in which the image is printed on the sheet by using remaining toner in the developing unit housing.

15. The image forming apparatus according to claim 14, wherein the inlet of the developing unit opens upward.

16. The image forming apparatus according to claim 14, further comprising an agitator configured to agitate the toner in the developing unit housing, wherein the inlet of the developing unit is located on an opposite side of an rotation axis of the agitator from the developing roller.

17. The image forming apparatus according to claim 14, wherein the developing unit uses single-component dry toner as the toner.

* * * * *